United States Patent [19]

Franco

[11] 4,378,069

[45] Mar. 29, 1983

[54] POUCH WITH POUR SPOUT

[75] Inventor: Gino Franco, Canoga Park, Calif.

[73] Assignee: Magna Technologies, Inc., Woodland Hills, Calif.

[21] Appl. No.: 256,081

[22] Filed: Apr. 21, 1981

[51] Int. Cl.[3] ..... B65D 65/28; B65D 27/34; B65D 47/10

[52] U.S. Cl. ..... 206/620; 206/634; 222/92; 222/107; 222/541; 426/115; 428/35; 156/69; 156/261; 156/293

[58] Field of Search ..... 206/620, 634; 222/541, 222/494, 92, 107; 426/115, 118; 428/35; 156/69, 261, 293

[56] References Cited

U.S. PATENT DOCUMENTS

| | | | |
|---|---|---|---|
| 3,157,312 | 11/1964 | Kitterman | 206/629 |
| 3,469,685 | 9/1969 | Baermann | 206/634 |
| 3,585,095 | 6/1971 | Shearwood | 156/261 |
| 3,821,046 | 6/1974 | Runge | 156/69 |
| 3,873,735 | 3/1975 | Chalin et al. | 206/605 |
| 4,072,233 | 2/1978 | Kramer et al. | 206/634 |
| 4,172,914 | 10/1979 | Festag et al. | 428/35 |
| 4,274,554 | 6/1981 | Malpas | 222/107 |

*Primary Examiner*—William R. Dixon, Jr.
*Attorney, Agent, or Firm*—Blakely, Sokoloff, Taylor & Zafman

[57] ABSTRACT

A plastic laminated pouch, suitable for containing food, beverages or other pourable contents, with an integrally formed generally cylindrical pour spout. Application of force directed radially inwardly upon the sidewalls of the pour spout causes the top of the spout to fracture generally along lines of reduced structural integrity provided thereon, permitting the contents of the pouch to be easily and neatly emptied therethrough.

18 Claims, 5 Drawing Figures

Fig. 1
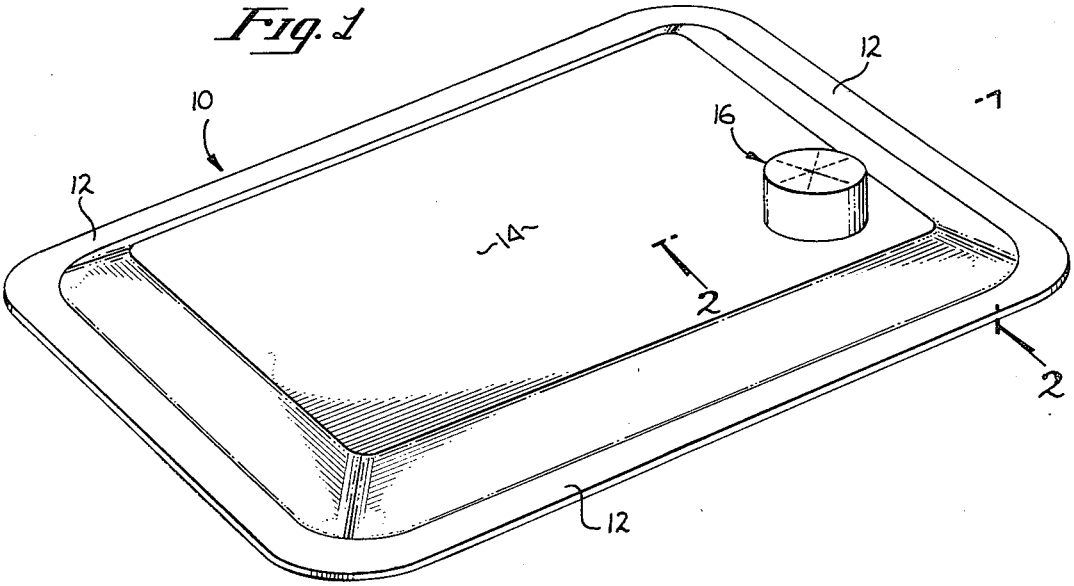
Fig. 2
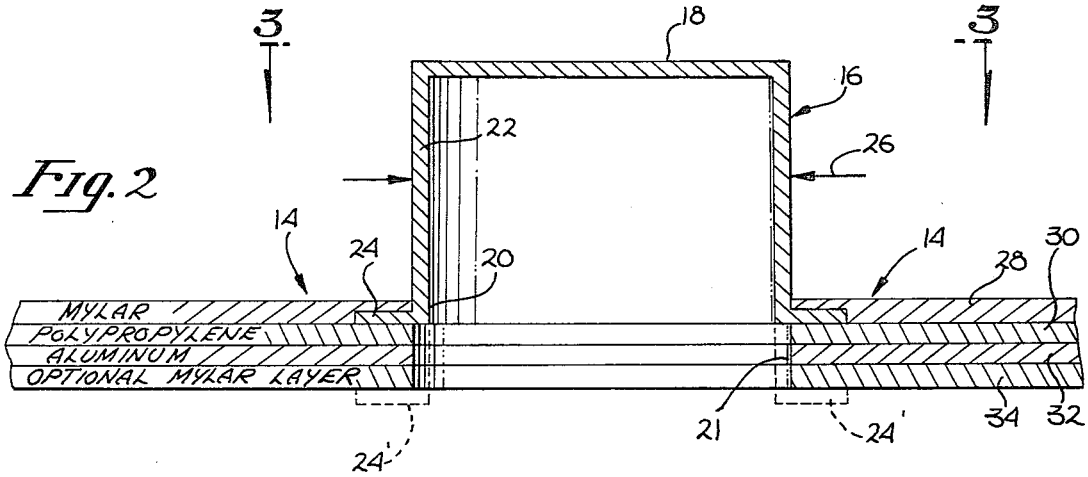
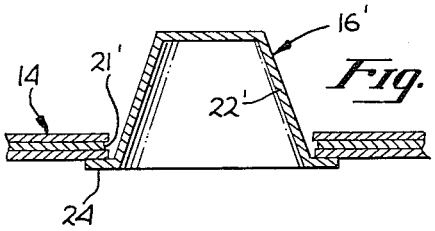
Fig. 4b
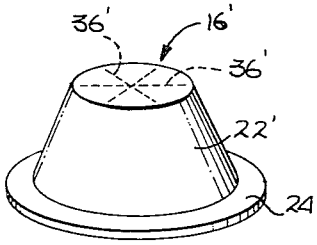
Fig. 4a
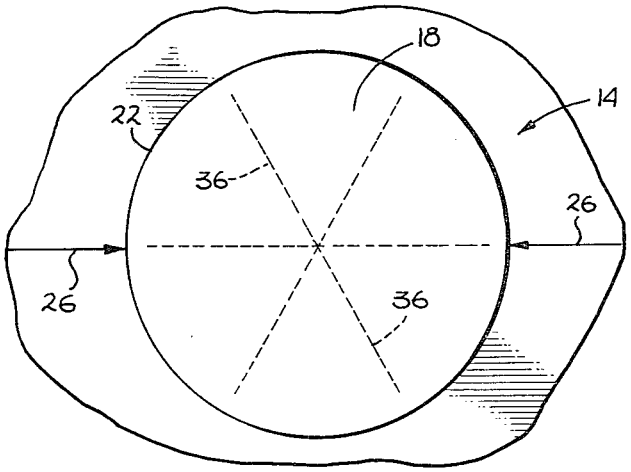
Fig. 3

POUCH WITH POUR SPOUT

PRIOR ART STATEMENT

This prior art statement is provided in conformance with Rule 1.98. The most pertinent references of which applicant is aware comprise the following U.S. patents, copies of which are enclosed.

| Patentee | U.S. Pat. No. | Issue Date |
|---|---|---|
| Baermann | 3,469,685 | 9/30/69 |
| Kitterman | 3,157,312 | 11/17/64 |
| Festag | 4,172,914 | 10/30/79 |
| Chalin | 3,873,735 | 3/25/75 |

Baermann shows a dome-like container 17 coupled to a pair of sheets 14 and 15 of vacuum formable plastic. The container houses a sheath 11 intended as a protective covering for a thermometer 12. The sheath is fitted to the thermometer by pushing the thermometer into one side of the container, and through and out the other side (see Column 2, lines 48–52).

Kitterman shows a thin-walled container 1 made of, as for example, synthetic resins such as polyethylene, polypropylene, and similar flexible plastics susceptible to heat sealing. A dispensing nozzle 13 is provided on the interior of the container for protrusion through a hole to be cut in one corner of the container.

Festag shows one form of an aluminum plastic laminate foil.

Chalin shows a number of food packages having layered plastic construction, see Col. 6–7.

SUMMARY OF THE INVENTION

A laminated plastic pouch, preferably for use as a food or beverage pouch, is constructed with an integral pour spout for easy dispensing of its contents. The pour spout may be generally cylindrical or somewhat conical with a flat top surface forming a closed first end. The other end is open, and provided with a radially outwardly extending flange. The pouch is provided with an aperture through which the body of the spout protrudes. The flange is of a diameter greater than the diameter of the aperture and serves to secure the spout in place within the aperture. The flange may be secured by adhesives (a casein latex is preferred) between layers of the laminated pouch or secured to the inside surface of the innermost layer of the laminate. In either case, the flat top surface of the spout is provided with a plurality of generally radially extending lines of reduced structural integrity. Application of radially inwardly directed force to the sidewalls of the spout will first fracture the spout generally along the lines of reduced structural integrity and permit easy dispensing of the contents of the pouch. The flexibility of the pouch permits the spout to withstand forces, of usually encountered magnitude, applied axially to the flat top surface of the spout without fracturing. The pour spout is thus not likely to fracture even when many pouches are packaged together as for shipment.

DESCRIPTION OF THE FIGURES

FIG. 1 shows a laminated plastic pouch with pour spout according to the invention.

FIG. 2 is a cross section of the pouch and pour spout taken along the line 2—2 of FIG. 1.

FIG. 3 is a top view of the closed end of the spout.

FIG. 4*a* is a perspective of an alternate geometric shape of pour spout.

FIG. 4*b* is a cross-section showing installation of the alternately shaped spout.

DETAILED DESCRIPTION OF THE INVENTION

A pouch 10, suitable for containing food or beverage is shown in FIG. 1. The pouch 10 is constructed by heat sealing the perimeter of two sheets of plastic laminate material. This forms a flange 12 on the perimeter of the pouch 10 and a central body portion 14 defining a volume for receiving the food or beverage. One of the two sheets of plastic laminate material is provided with an aperture for receiving the plastic (polystyrene) pour spout 16. The method of securing the pour spout 16 to the sheet of plastic laminate is best illustrated by FIG. 2.

The plastic pour spout 16 has a closed top end 18 and an open bottom end 20 which communicates with the interior of the pouch through aperture 21. The spout 16 has a generally cylindrical sidewall 22 and a flange 24 extending radially outwardly from the open end 20 of the spout 16. The sheet of laminated material may be made of a variety of layers of material, depending on the particular application. The configuration preferred herein for use with foods and beverages is an outer layer 28 of polyester, a middle layer 30 of polypropylene and an inner layer 32 of aluminum. The pouch 10 can be employed in any application involving contents which can be easily poured through the spout 16. For example, mouth wash, solvents, or other commercially available liquids or gels can be contained within the pouch. When it is desired to contain in the pouch a food or beverage that might chemically react with the aluminum layer 32, there may be provided a further layer 34 on the interior surface of the aluminum. Layer 34 would preferably be another layer of polyester.

The pour spout 16 is secured within aperture 21 with the aid of flange 24. Flange 24 may be positioned between adjacent layers of the laminate or, as shown by flange 24', may be positioned on the interior side of the innermost layer (32 or 34 depending on the nature of the laminate) and adhered thereto by a suitable adhesive (such as a casein latex) or by heat sealing.

The closed end 18 is provided with a plurality of generally radially extending lines 36 of reduced structural integrity. These lines 36 provide a slight weakening of the strength of the closed end 18. By applying a radially inwardly directed force, as indicated by force arrows 26, a user will cause the closed end 18 to fracture generally along the direction of lines 36 providing for ready and neat dispensing of the contents of the pouch 10. While lines 36 are shown in the Figures as being generally radially extending, non-radially extending lines 36 may be preferred for some applications.

While the pour spout 16 has been shown as cylindrically shaped in FIGS. 1 through 3, the spout could as easily be made generally conical in shape as is pour spout 16' of FIGS. 4*a* and 4*b*. Pour spout 16' has a sidewall 22' in the shape of a section of a cone. The pour spout 16' is retained in aperture 21' by flange 24 in a manner like that of pour spout 16. The conical pour spout 16' is similarly provided with a plurality of radially extending lines 36' which function just like lines 36, ie., they provide lines of reduced structural integrity.

Because the lines 36 or 36' are coplanar with the material forming the closed end 18 of the spout 16, they are less susceptible to fracture in response to forces directed along the axis of the spout. The flexibility of the pouch 10 and its contents tends to absorb and distribute such forces and prevent fracture. The pouch and pour spout may thus be safely stored in packages containing many pouches, with relatively small risk of fracture of any lines 36. Forces directed radially inwardly upon the sidewall 22 tend to bend the plane of the closed end 18, thus stressing the lines 36 and initiating fracture.

While the invention has been described with reference to specific materials in FIGS. 1–4*b*, these are for purposes of illustration only and are not intended to be used to define the limits of the invention. It should be understood that many changes and modifications, both as to material and construction, could be made by one of ordinary skill in the art, without departing from the spirit and scope of the invention as set forth in the appended claims.

What is claimed is:

1. A flexible container comprising:

a plastic laminate pouch having an aperture defined through a wall thereof;

a pour spout having flexible sides fitted within said aperture, said pour spout including an open end communicating with the interior of said pouch and a closed end protruding from said pouch;

said open end having an outwardly extending flange disposed about the edge thereof, said flange having a diameter greater than the diameter of said aperature, and said closed end having a plurality of lines of reduced structural integrity extending across the surface thereof, whereby the application of a force directed inwardly against the sides of said spout transverse to the longitudinal axis thereof deforms the peripheral edge of said closed end which deforms the planer surface of said closed end, such that stresses induced therein cause said closed end to fracture generally along said lines of reduced structural integrity.

2. The container as claimed in claim 1 wherein said spout is resistent to fracture from the application of force axial to the general plane of said closed end.

3. The container as claimed in claim 2 wherein said sides of said spout are sufficiently long to accomodate human fingers for squeezing said sides.

4. The container as claimed in claim 3 wherein said pour spout is of unitary plastic construction.

5. The container as claimed in claim 4 wherein said pour spout is comprised of polystyrene.

6. The container as claimed in claim 4 wherein said lines of reduced structural integrity extend radially from the centerpoint of said closed end.

7. The container as claimed in claim 4 wherein said pour spout is generally cylindrical.

8. The container as claimed in claim 4 wherein said spout is generally frustoconical.

9. The container as claimed in claim 1 wherein said laminate structure of said pouch comprises:

(a) an outer layer of polyester;

(b) a middle layer of polypropylene; and (c) an inner layer of aluminum.

10. The container as claimed in claim 9, wherein said laminate structure further comprises an innermost layer of polyester.

11. The container as claimed in claim 1 wherein said flange is sealably secured to said wall of said pouch between lamination layers.

12. The container as claimed in claim 1 wherein said flange is sealably secured to said wall on the interior surface of the innermost layer of said laminate.

13. A method for forming a pouch which incorporates a pour spout comprising the steps of:

(a) fabricating a first sheet of laminate material;

(b) fabricating a second sheet of laminate material;

(c) defining at least one aperature through said first sheet of laminate material for mateably receiving a flange thereagainst;

(d) forming a flexible plastic pour spout having an open end and a closed end;

(e) forming an integral flange along the open end of said pour spout extending outwardly perpendicular to the longitudinal axis of said pour spout;

(f) reducing the structural integrity of said closed end along at least one line defined at least some distance across the plane of said closed end whereby said closed end is frangible when force is applied inwardly against the sides of said spout perpendicular to the longitudinal axis thereof, and whereby said closed end is resistent to puncture from forces applied axially thereagainst;

(g) positioning said spout within said aperature such that said flange abuts the shoulder of said aperture;

(h) sealably securing said flange to said shoulder of said aperature; and (i) sealably engaging the surfaces of said first sheet of laminate material and said second sheet of laminate material such that a sealed storage volume in communication with said open end of said pour spout is defined therein.

14. The method of claim 13 wherein the step of sealably securing said flange to said shoulder comprises the steps of:

(a) applying an adhesive between the mating surfaces of said flange and said first sheet of laminate material;

(b) pressing said mating surfaces together; and (c) curing said adhesive such that said mating surfaces form a sealed union.

15. The method as claimed in claim 13 wherein the step of fabricating said first sheet of laminate material comprises the steps of:

(a) providing an outer layer of polyester, a middle layer of polypropylene, and an inner layer of aluminum;

(b) stacking said layers atop one another; and (c) bonding said outer layer, said middle layer, and said inner layer together.

16. The method as claimed in claim 13 wherein the step of fabricating said second sheet of laminated material comprises the steps of:

(a) providing an outer layer of polyester, a middle layer of polypropylene, and an inner layer of aluminum;

(b) stacking said layers atop one another; and (c) bonding said outer layer, said middle layer, and said inner layer together.

17. The method of forming a pouch which incorporates a pour spout comprising the steps of:

(a) forming a flexible plastic pour spout having an open end and a closed end;

(b) forming an integral flange along the open end of said pour spout extending outwardly perpendicular to the longitudinal axis of said pour spout;

(c) fabricating a first sheet of laminate material by providing an outer layer of polyester, a middle layer of polypropylene, and an inner layer of aluminum, stacking said layers atop one another, forming an aperture through said layers, interposing said flange between two of said layers, adhesively securing said flange to adjacent layers, and bonding said outer layer, said middle layer, and said inner layer together;

(d) reducing the structural integrity of said closed end along at least one line defined at least some distance across the plane of said closed end whereby said closed end is frangible when force is applied inwardly against the sides of said spout perpendicular to the longitudinal axis thereof, and whereby said closed end is resistent to puncture from forces applied axially thereagainst;

(e) fabricating a second sheet of laminate material by bonding together an outer layer of polyester, a middle layer of polypropylene, and an inner layer of aluminum; and (f) sealably engaging the surfaces of said first sheet of laminate material and said second sheet of laminate material such that a sealed storage volume in communication with said closed end of said pour spout is defined therein.

18. A method of forming a pouch which incorporates a pour spout comprising:

(a) forming a pouch of plastic laminate material with an aperature defined therein;

(b) forming a flexible plastic pour spout having an open end and a closed end such that said closed end opens upon the application of force applied inwardly against the sides of said spout perpendicular to the longitudinal axis thereof; and (c) securing said pour spout to said pouch such that said open end is in communication with the interior of said pouch.

* * * * *